US009476315B2

(12) United States Patent
Shibata et al.

(10) Patent No.: US 9,476,315 B2
(45) Date of Patent: Oct. 25, 2016

(54) AXIAL FLOW TURBINE

(71) Applicant: Mitsubishi Hitachi Power Systems, Ltd., Nishi-ku, Yokohama, Kanagawa (JP)

(72) Inventors: Takanori Shibata, Tokyo (JP); Noriyo Nishijima, Tokyo (JP); Kiyoshi Segawa, Tokyo (JP); Hisataka Fukushima, Tokyo (JP); Goingwon Lee, Tokyo (JP)

(73) Assignee: Mitsubishi Hitachi Power Systems, Ltd., Yokohama (JP)

( * ) Notice: Subject to any disclaimer, the term of this patent is extended or adjusted under 35 U.S.C. 154(b) by 311 days.

(21) Appl. No.: 14/061,195

(22) Filed: Oct. 23, 2013

(65) Prior Publication Data

US 2014/0119901 A1 May 1, 2014

(30) Foreign Application Priority Data

Oct. 25, 2012 (JP) ..... 2012-235388

(51) Int. Cl.
*F01D 11/00* (2006.01)
*F01D 11/08* (2006.01)
*F01D 5/22* (2006.01)

(52) U.S. Cl.
CPC ..... *F01D 11/08* (2013.01); *F01D 5/225* (2013.01)

(58) Field of Classification Search
CPC ..... F01D 11/08
USPC ..... 415/173.3, 173.5–173.7; 416/171, 192
See application file for complete search history.

(56) References Cited

U.S. PATENT DOCUMENTS 4,370,094 A * 1/1983 Ambrosch ..... F01D 11/08 415/119
4,571,937 A * 2/1986 Albers ..... F01D 11/08 415/115

(Continued)

FOREIGN PATENT DOCUMENTS

EP 2 096 262 A1 9/2009
JP 57-8302 A 1/1982

(Continued)

OTHER PUBLICATIONS

Rosic, et al., "The Control of Shroud Leakage Loss by Reducing Circumferential Mixing", Proceedings of GT2006, ASME Turbo Expo 2006: Power for Land, Sea and Air, May 8-11, 2006, Barcelona, Spain. pp. 1-9.

(Continued)

*Primary Examiner* — Woody Lee, Jr.
(74) *Attorney, Agent, or Firm* — Crowell & Moring LLP

(57) ABSTRACT

An axial flow turbine that can enhance an effect of reducing a mixing loss is disclosed. The axial flow turbine includes a plurality of stator blades provided on the inner circumferential side of a diaphragm outer ring; a plurality of rotor blades provided on the outer circumferential side of a rotor; a shroud provided on the outer circumferential side of the plurality of rotor blades; an annular groove portion formed in the diaphragm outer ring and housing the shroud therein; a clearance passage defined between the groove portion and the shroud, into which a portion of working fluid flows from the downstream side of the stator blades in a main passage; seal fins provided in the clearance passage; a circulation flow generating chamber defined on the downstream side of the clearance passage; and a plurality of shielding plates secured to the diaphragm outer ring.

3 Claims, 5 Drawing Sheets

(56) References Cited

U.S. PATENT DOCUMENTS

| | | | | |
|---|---|---|---|---|
| 6,736,596 | B2 * | 5/2004 | Ito | F01D 5/225 415/173.1 |
| 8,708,639 | B2 * | 4/2014 | Subramaniyan | F01D 5/143 415/1 |
| 8,834,107 | B2 * | 9/2014 | Valliappan | F01D 5/225 415/173.5 |
| 2004/0096319 | A1 | 5/2004 | Uchida et al. | |
| 2008/0118350 | A1 | 5/2008 | Feeny et al. | |
| 2013/0094945 | A1 | 4/2013 | Kuwamura et al. | |
| 2013/0149124 | A1 | 6/2013 | Kuwamura et al. | |
| 2013/0230379 | A1 * | 9/2013 | Ali | F01D 5/225 415/1 |

FOREIGN PATENT DOCUMENTS

| | | | | |
|---|---|---|---|---|
| JP | 58-165201 | U | | 11/1983 |
| JP | 2002-285802 | A | | 10/2002 |
| JP | 2004-11553 | A | | 1/2004 |
| JP | 2006104952 | A | * | 4/2006 |
| JP | 2006-138259 | A | | 6/2006 |
| JP | 2008-128240 | A | | 6/2008 |
| JP | 2010-275957 | A | | 12/2010 |
| JP | 2011-106474 | A | | 6/2011 |
| JP | 2011-247158 | A | | 12/2011 |
| JP | 2012-2234 | A | | 1/2012 |
| JP | 2012002234 | A | * | 1/2012 |
| JP | 2012-62863 | A | | 3/2012 |

OTHER PUBLICATIONS

Wallis, et al., "The Control of Shroud Leakage Flows to Reduce Aerodynamic Losses in a Low Aspect Ratio, Shrouded Axial Flow Turbine", Proceedings of ASME Turboexpo 2000, May 8-11, 2000, Munich Germany. pp. 1-9.

Korean Office Action dated Oct. 24, 2015 with English-language translation (Seven (7) pages).

Japanese-language Office Action issued in counterpart Japanese Application No. 2012-235388 dated Mar. 1, 2016 (five (5) pages).

Extended European Search Report issued in counterpart European Application No. 13189872.8 dated Apr. 26, 2016 (eight (8) pages).

* cited by examiner

AXIAL FLOW TURBINE

BACKGROUND OF THE INVENTION

1. Field of the Invention

The present invention relates to an axial flow turbine used as a steam turbine, a gas turbine or the like for a power-generating plant.

2. Description of the Related Art

An improvement in the power generation efficiency of the power-generating plant has recently led to a strong demand for further improved turbine performance. The turbine performance has a relationship with a stage loss, an exhaust loss, a mechanical loss and the like associated with the turbine, and it is considered most effective to reduce the stage loss among them for further improvement.

The stage loss includes various losses, which are broadly divided into:

(1) a profile loss attributable to airfoil per se, (2) a secondary flow loss attributable to a flow not along with a main flow, and (3) a leakage loss caused by working fluid (steam, gas or the like) leaking to outside the main passage.

The above leakage loss includes:

(a) a bypass loss caused by a portion (leaking fluid) of the working fluid flowing through a clearance passage (a bypass passage) other than the main passage, making the energy in the leaking fluid not effectively utilized.

(b) a mixing loss caused when the leaking fluid flows from the clearance passage into the main passage; and (c) an interference loss caused by the interference of the leaking fluid flowing into the main passage with a blade row on the downstream side thereof.

An important issue in recent years is to reduce not only the bypass loss but the mixing loss and the interference loss. In other words, the important issue is not only to simply reduce the flow rate (a leakage amount) of the leaking fluid from the main passage into the clearance passage but how to return the leaking fluid from the clearance passage into the main passage with no loss.

To solve such problems, it is proposed that a plurality of guide plates is provided on the downstream side of the clearance passage so as to change the flowing direction of the leaking fluid to the main flow direction. (See JP-2011-106474-A)

SUMMARY OF THE INVENTION

However, the conventional art has room for the improvement as below. Specifically, the conventional art described in JP-2011-106474-A only allows the leaking fluid to pass between the guide plates to change the flowing direction of the leaking fluid. Therefore, unless the number of the guide plates is increased to narrow the interval between the guide plates, an effect of changing the flowing direction of the leaking fluid cannot sufficiently be produced, which leads to a possibility that the effect of reducing the mixing loss cannot be sufficiently obtained. Contrarily, if the number of the guide plates is increased to narrow the interval between the guide plates, increase in a contact area increases a friction loss, which may cancel out the effect of reducing the mixing loss.

It is an object of the present invention to provide an axial flow turbine that can enhance an effect of reducing a mixing loss.

According to one aspect of the present invention, an axial flow turbine includes: a plurality of stator blades provided on the inner circumferential side of a stationary body and circumferentially arranged; a plurality of rotor blades provided on the outer circumferential side of a rotating body and circumferentially arranged; a main passage in which the stator blades and the rotor blades on the downstream side of the stator blades are arranged, the main passage through which working fluid flows; a shroud provided on the outer circumferential side of the rotor blades; an annular groove portion formed in the stationary body and housing the shroud therein; a clearance passage formed between the groove portion and the shroud, wherein a portion of the working fluid flows from the downstream side of the stator blades in the main passage into the clearance passage and flows out toward the downstream side of the rotor blades in the main passage; a plurality of stages of seal fins provided in the clearance passage; a circulation flow generating chamber defined on the downstream side of the clearance passage; and a plurality of shielding plates secured to the stationary body in such a manner as to be located in the circulation flow generating chamber, the shielding plates extending in axial and radial directions of the rotating body.

In the aspect of the present invention described above, a portion of working fluid (leaking fluid) flows into the clearance passage from the downstream side of the stator blade (the upstream side of the rotor blade in the main passage) and flows out toward the downstream side of the rotor blade in the main passage via the clearance passage. In this case, the leaking fluid that has flowed into the clearance passage from the downstream side of the stator blade in the main passage forms a flow having a large circumferential velocity component. However, a portion of the leaking fluid flows into the circulation flow generating chamber and hits the shielding plates, which can generate a circulation flow having a suppressed circumferential velocity component. The interference of the circulation flow thus generated can effectively reduce the circumferential velocity component of the flow of the leaking fluid flowing out from the clearance passage toward the downstream side of the rotor blade in the main passage. Thus, the flowing direction of the leaking fluid can coincide with that of the working fluid (the main-flow fluid) that has passed the rotor blade, which enhances the effect of reducing the mixing loss.

The present invention can enhance the effect of reducing the mixing loss.

DESCRIPTION OF THE PREFERRED EMBODIMENTS

Preferred embodiments of a steam turbine according to the present invention will now be described with reference to the accompanying drawings.

Figure 1:
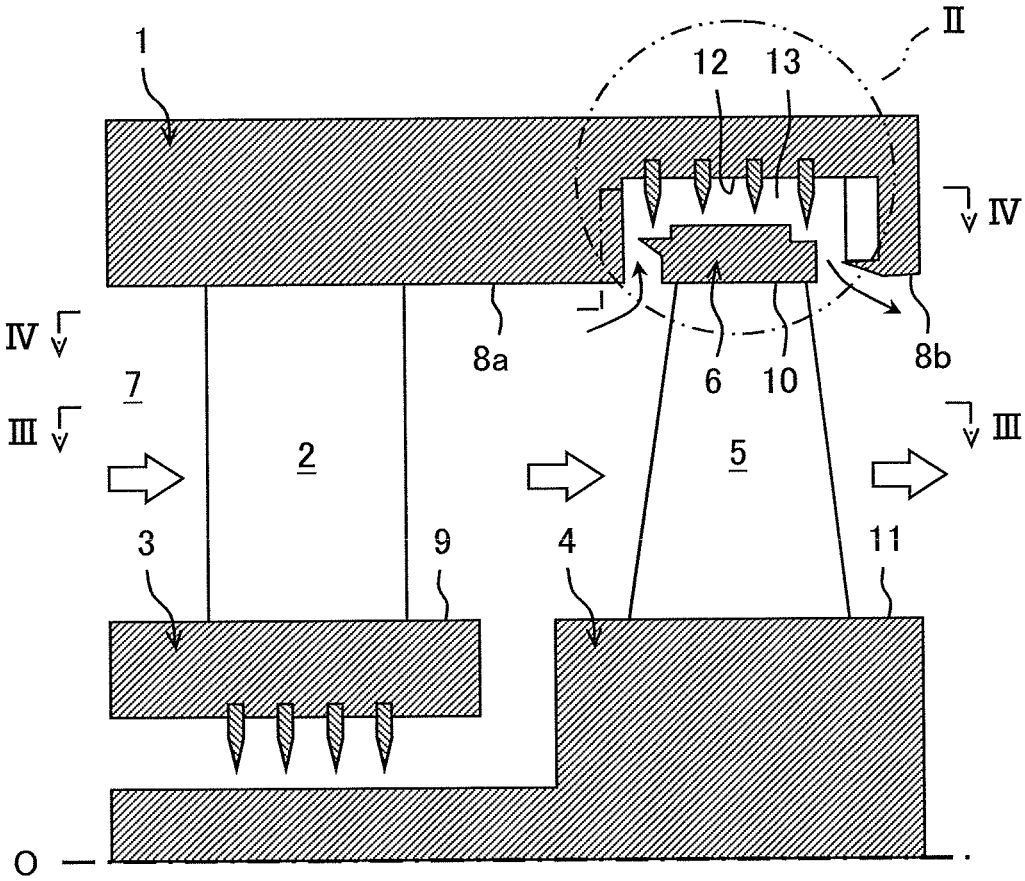
FIG. 1 is a rotor-axial cross-sectional view schematically illustrating a partial structure of a steam turbine according to a first embodiment of the present invention.
Figure 2:
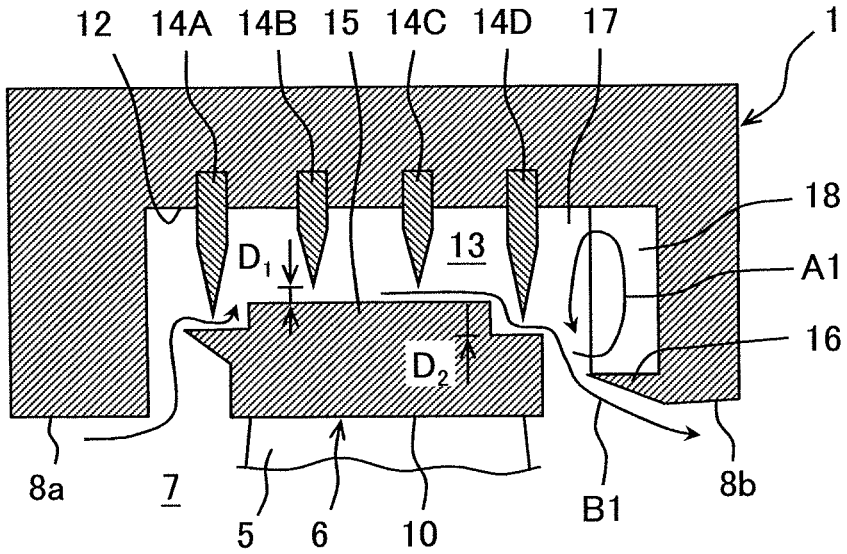
FIG. 2 is a partially-enlarged cross-sectional view of a II-portion in FIG. 1, illustrating a detailed structure of a clearance passage according to the first embodiment of the present invention.
Figure 3:
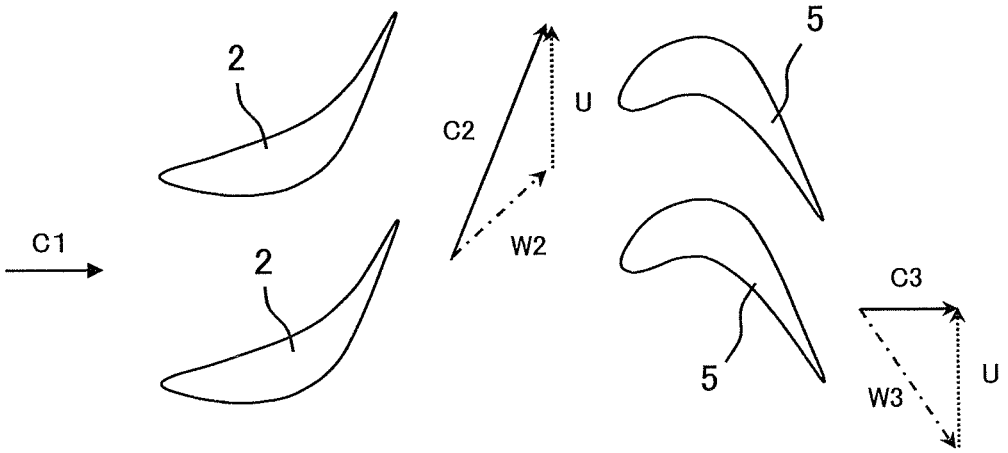
FIG. 3 is a rotor-circumferential cross-sectional view taken along line III-III in FIG. 1, illustrating the flow in a main passage.
Figure 4:
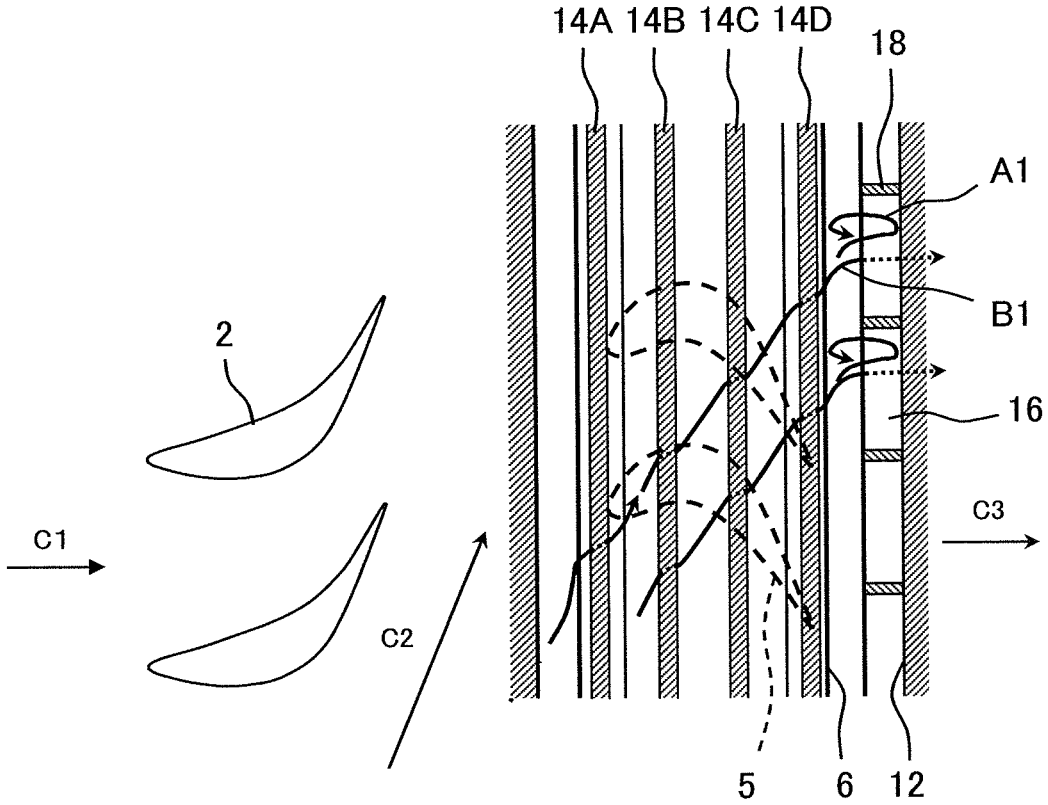
FIG. 4 is a rotor-circumferential cross-sectional view taken along line IV-IV in FIG. 1, illustrating the flow in the clearance passage as well as the flow in the main passage.

FIG. 1 is a schematic cross-sectional view of a partial structure (a stage structure) of a steam turbine as viewed in a rotor-axial direction according to a first embodiment of the present invention. FIG. 2 is a partial enlarged cross-sectional view of a II-part in FIG. 1, illustrating a detailed structure of a clearance passage. FIG. 3 is a cross-sectional view as viewed in a rotor-circumferential direction taken along line III-III in FIG. 1, illustrating a flow in a main passage. FIG. 4 is a cross-sectional view as viewed in the rotor-circumferential direction taken along line IV-IV, illustrating a flow in the clearance passage together with the flow in the main passage.

Referring to FIGS. 1 to 4, a steam turbine includes an annular diaphragm outer ring 1 (a stationary body) provided on the inner circumferential side of a casing (not shown), a plurality of stator blades 2 provided on the inner circumferential side of the diaphragm outer ring 1, and an annular diaphragm inner ring 3 provided on the inner circumferential side of the stator blades 2. The plurality of stator blades 2 are arranged at given intervals in a circumferential direction between the diaphragm outer ring 1 and the diaphragm inner ring 3.

The steam turbine includes a rotor 4 (a rotating body) rotating around a rotating axis o, a plurality of rotor blades 5 provided on the outer circumferential side of the rotor 4, and an annular shroud 6 provided on the outer circumferential side of the rotor blades 5 (i.e., the blade-tip side of the rotor blades 5). The rotor blades 5 are arranged between the rotor 4 and the shroud 6 at given intervals in the circumferential direction.

A main passage 7 for steam (working fluid) is composed of a passage defined between an inner circumferential surface 8*a* of the diaphragm outer ring 1 and an outer circumferential surface 9 of the diaphragm inner ring 3, a passage defined between an inner circumferential surface 10 of the shroud 6 (and an inner circumferential surface 8*b* of the diaphragm outer ring 1) and an outer circumferential surface 11 of the rotor 4, and other passages. In the main passage 7, the stator blades 2 (i.e., a single stator blade row) are arranged. The rotor blades 5 (i.e., a single rotor blade row) are arranged on the downstream side of the stator blade row. A combination of the stator blades 2 and the rotor blades 5 constitutes one stage. Although one stage is illustrated in FIG. 1 for convenience, a plurality of the stages are provided in the rotor-axial direction in order to recover the inside energy of steam efficiently.

The steam in the main passage (i.e. a main flow steam) flows as indicated by blank arrows in FIG. 1. The inside energy of steam (i.e. pressure energy or the like) is converted into kinetic energy (i.e. velocity energy) by the stator blades 2, and the kinetic energy of steam is converted into the rotational energy of the rotor 4 by the rotor blades 5. A generator (not shown) is connected to an end of the rotor 4. The rotational energy of the rotor 4 is converted into electric energy by the generator.

A detailed description is given of the flow (main flow) of the steam in the main passage 7. The steam flows in from the leading edge side (the left side in FIG. 3) of the stator blade 2 at an absolute velocity vector C1 (specifically, an axial flow that has almost no circumferential velocity component). When passing between the stator blades 2, the steam increases in velocity and changes in direction to have an absolute velocity vector C2 (specifically, the flow having a large circumferential velocity component). Then, the steam flows out from the trailing edge side (the right side in FIG. 3) of the stator blade 2. A large portion of the steam flowing out from the stator blade 2 hits the rotor blades 5 to rotate the rotor 4 at velocity U. In this case, when passing the rotor blades 5, the steam decreases in velocity and changes in direction, so that its relative velocity vector W2 changes into a relative velocity vector W3. Thus, the steam that flows out from the rotor blade 5 forms a flow having an absolute velocity vector C3 (specifically, which is nearly equal to the absolute velocity vector C1 and which is an axial flow that has almost no circumferential velocity component).

An annular groove portion 12 for housing the shroud 6 is formed in the inner circumferential surface of the diaphragm outer ring 1. A clearance passage (a bypass passage) 13 is defined between the groove portion 12 and the shroud 6. As a leaking flow, a portion (leaking steam) of steam flows from the downstream side of the stator blade 2 (i.e., the upstream side of the rotor blade 5) in the main passage 13 into the clearance passage 13. The leaking steam flows out toward the downstream side of the rotor blade 5 in the main passage 7 via the clearance passage 13. Thus, the internal energy of the leaking steam is not effectively utilized, which leads to a bypass loss. To reduce the bypass loss, that is, to reduce the flow rate (the amount of leaking) of the leaking steam from the main passage 7 to the clearance passage 13, a labyrinth seal is provided in the clearance passage 13.

The labyrinth seal of the present embodiment has annular seal fins (14A to 14D) provided on the inner circumferential surface of the groove portion 12. These seal fins (14A to 14D) are arranged at given intervals in a rotor-axial direction. The seal fins (14A to 14D) have tip portions (inner circumferential side edge portions) each of which is formed into an acute wedge shape. An annular stepped portion (a raised portion) is formed on the outer circumferential side of the shroud 6 in such a manner as to be located between the first-stage seal fin 14A and the fourth-stage seal fin 14D.

A clearance dimension $D_1$ between the tip of each seal fin and the outer circumferential surface of the shroud 6 facing thereto is set so that the flow rate of the leaking steam is minimized while preventing the contact between the stationary body side and the rotating body side. A step dimension $D_2$ of the stepped portion 15 is set, for example, two to three times the clearance dimension $D_1$ mentioned above. Therefore, the seal fins (14A, 14D) are longer than the seal fins (14B, 14C) by the above-mentioned step dimension $D_2$.

The main-flow steam in the main passage 7 on the downstream side of the stator blade 2 forms the flow having the large circumferential velocity component (the absolute velocity vector C2) as mentioned above. In addition, the leaking steam flowing into the clearance passage 13 forms the flow having the large circumferential velocity component. The leaking steam flowing into the clearance passage 13 sequentially passes through clearances (restrictions) between the tip of the first-stage seal fin 14A and the outer circumferential surface of the shroud 6, between the tip of the second-stage seal fin 14B and the outer circumferential surface of the shroud 6, between the tip of the third-stage seal fin 14C and the outer circumferential surface of the shroud 6, and between the tip of the fourth-stage seal fin 14D and the shroud 6. In this case, the total pressure of the leaking steam lowers due to a loop loss. Although the axial velocity of the leaking steam increases, the circumferential velocity remains almost unchanged. In other words, the leaking steam passing through the clearance between the tip of the final-stage seal fin 14D and the outer circumferential surface of the shroud 6 still forms the flow having the large circumferential velocity component.

On the other hand, the mainstream steam that has passed the rotor blade 5 in the main passage 5 forms the flow that has almost no circumferential velocity component as described above, i.e., the flow having the absolute velocity vector C3. Therefore, if the leaking steam that has passed through the clearance between the tip of the final-stage seal fin 14D and the outer circumferential surface of the shroud 6 flows out toward the downstream side of the rotor blade 5 in the main passage 7 while the leaking steam still has the large circumferential velocity component, a mixing loss increases.

As the greatest feature of the present embodiment, provided is an annular projecting portion (a first projecting portion) 16 projecting toward the downstream-side end face of the shroud 6 on the downstream-side lateral surface of the groove portion 12 of the diaphragm outer ring 1. In this way, a circulation flow generating chamber 17 is defined on the downstream side of the clearance passage 13. This circulation flow generating chamber 17 is defined by a portion of the inner circumferential surface of the groove portion 12 located on the downstream side of the final-stage seal fin 14D, the downstream-side lateral surface of the groove portion 12 and the outer circumferential surface, i.e., a radial outside surface of the projecting portion 16. A portion of the leaking steam that has passed through the clearance between the tip of the final-stage seal fin 14D and the outer circumferential surface of the shroud 6 flows into the circulation flow generating chamber 17 and hits the downstream-side lateral surface of the groove portion 12 and other surfaces to form a circulation flow A1.

Further, a plurality of shielding plates arranged at given intervals in the circumferential direction are secured to the downstream-side lateral surface of the groove portion 12 (i.e., in the circulation flow generating chamber 17). The shielding plate 18 extends in the rotor-axial direction and the rotor-radial direction, and is a flat plate disposed perpendicularly to the tangential direction of the rotation of the rotor 4 in the present embodiment. The leaking steam (i.e., the circulation flow A1) flowing into the circulation flow generating chamber 17 hits the shielding plates 18, thereby suppressing the circumferential velocity component of the circulation flow A1 (see FIG. 4). The interference of the circulation flow A1 thus generated can effectively remove the circumferential velocity component from the flow B1 of the leaking steam flowing out toward the downstream side of the rotor blade 5 in the main passage 7 from the clearance passage 13 (see FIG. 4). In other words, the circumferential velocity component can effectively be removed regardless of the magnitude of the circumferential velocity of the leaking steam compared with the case where leaking steam is allowed to pass between the guide plates as described in e.g. JP-2011-106474-A.

The tip of the projecting portion 16 is located on the rotor-radial inside of the outer circumferential surface of the shroud 6 to which the final-stage seal fin 14D is opposed. The leaking steam that has passed through the clearance between the tip of the final-stage seal fin 14D and the outer circumferential surface of the shroud 6 easily enters the circulation flow generating chamber 17.

The projecting portion 16 fills the role of suppressing the radial velocity component of the flow B1 of the leaking steam flowing out from the clearance passage 13 toward the downstream side of the rotor blade 5 in the main passage 7. In particular, the inner circumferential surface of the projecting portion 16 inclines from the outside (the upside in FIG. 2) toward the inside (the downside in FIG. 2) in the rotor-radial direction in such a manner as to extend from the upstream side (the left side in FIG. 2) toward the downstream side (the right side in FIG. 2) in the rotor-axial direction. Thus, the leaking steam is directed in the rotor-axial direction. The projecting portion 16 plays the role of preventing the steam from flowing back from the main passage 7 toward the clearance passage 13.

The final-stage seal fin 14D is located to oppose to the outer circumferential surface of the axially downstream end portion of the shroud 6. With such arrangement of the final-stage seal fin, the leaking flow which has passed through the clearance between the tip of the final-stage seal fin 14D and the outer circumferential surface of the shroud 6 moves into the circulation flow generating chamber 17 in the state where high velocity is maintained without the circumferential diffusion of velocity. Thus, the strong circulation flow A1 can be generated. Contrarily, if the final-stage seal fin is located on the axially upstream side of the shroud 6, the leaking flow B1 that has passed through the clearance between the tip of the final-stage seal fin and the outer circumferential surface of the shroud 6 is diffused over the full area of the leaking passage and flows into the circulation flow generating chamber 17 as the leaking flow having a radially uniform velocity. Therefore, the circulating flow A1 cannot be generated. To generate the circulation flow A1, it is essential to locate the final-stage seal fin 14D to oppose to the outer circumferential surface of the axially downstream end portion of the shroud 6 so as to allow the leaking flow B1 to flow into the circulation flow generating chamber 17 in the state of a high-velocity jet flow.

Advantages of the present embodiment are next described with reference to FIGS. 5 and 6.

Figure 5:
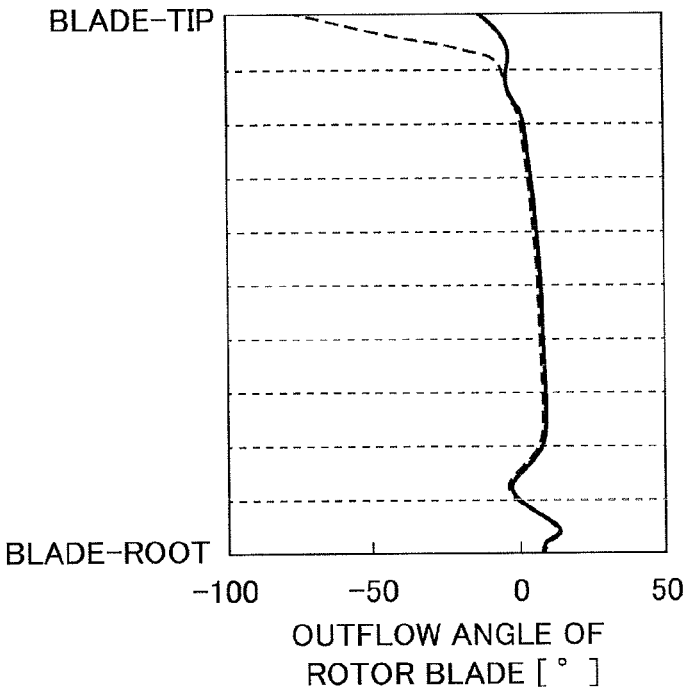
FIG. 5 is a chart illustrating the distribution of rotor blade outflow angles in the first embodiment of the present invention and in the conventional art.
Figure 6:
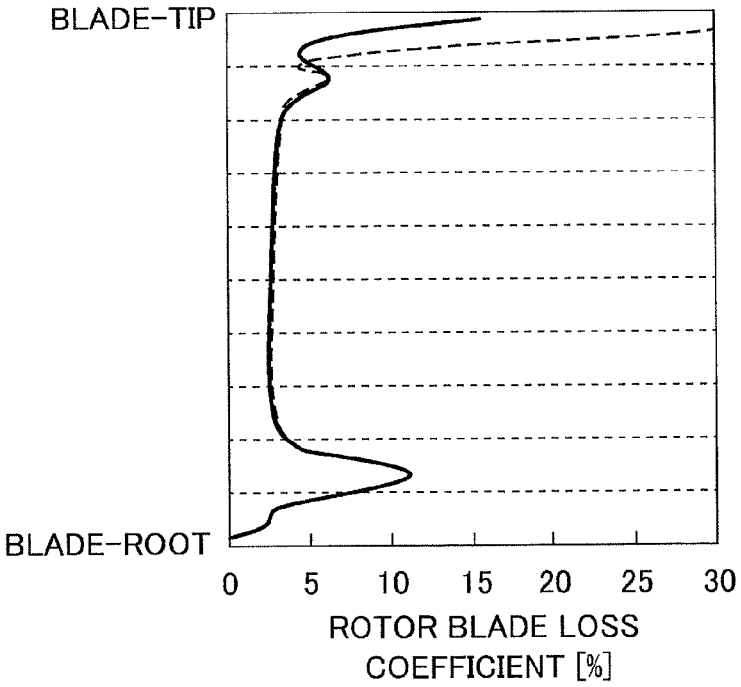
FIG. 6 is a chart illustrating the distribution of rotor blade loss coefficients in the first embodiment of the present invention and in the conventional art.

FIG. 5 is a chart illustrating the distribution of rotor blade outflow angles in the present embodiment indicated by a solid line and the distribution of rotor blade outflow angles in the conventional art indicated by a dotted line. A longitudinal axis represents a blade-height-directional position in the main passage 7, and a horizontal axis represents an outflow angle of the rotor blade (i.e., an absolute flow angle of steam on the downstream side of the rotor blade 5). With the rotor-axial direction as a basis (is set as zero), as the circumferential velocity is greater in respective with the axial velocity the absolute value of the outflow angle of the rotor blade 5 gradually approaches 90 degrees. FIG. 6 is a chart illustrating the distribution of a rotor blade loss coefficient in the present embodiment indicated by a solid line and the distribution of a rotor blade loss coefficient in the conventional art indicated by a dotted line. A longitudinal axis represents the blade-height-directional position in the main passage 7, and a horizontal axis represents the loss coefficient of the rotor blade 5.

As described above, the leaking steam flows from the downstream side of the stator blade 2 (i.e., the upstream side of the rotor blade 5) in the main passage 7 into the clearance passage 13 and then flows out toward the downstream side of the rotor blade in the main passage 7 through the clearance passage 13. In this case, the leaking steam flowing from the downstream side of the stator blade 2 in the main passage 7 into the clearance passage 13 forms a flow having a large circumferential velocity component. The leaking steam that has passed the clearance between the tip of the final-stage seal fin 14D and the outer circumferential surface of the shroud 6 also forms a flow having a large circumferential velocity component.

In the conventional art without the above-mentioned projecting portion 16 and the shielding plates 18, the leaking steam flowing out from the clearance passage 13 into the main passage 7 has a flow having a large circumferential velocity component. Meanwhile, the main-flow steam that has passed the rotor blade 5 in the main passage 7 forms a flow that has almost no circumferential velocity component as described above. Therefore, as shown in FIG. 5, a flow angle in an area other than the vicinity of the blade tip is nearly equal to zero; however, it comes close to −90 degree in an area close to the blade tip. In the conventional art, the projecting portion 16 does not exit; therefore, the leaking steam flowing out from the clearance passage 13 into the main passage 7 has relatively large radial velocity. As shown in FIG. 5, the blade-height-directional area subjected to the influence of the leaking steam is relatively large. As shown in FIG. 6, a mixing loss increases as a result.

In contrast to the conventional art, in the present embodiment, the circulation flow having the suppressed circumferential velocity component is generated on the downstream side of the clearance passage 13. The interference of the circulation flow can effectively remove the circumferential velocity component from the flow of the leaking steam flowing out from the clearance passage 13 toward the downstream side of the rotor blade 5 in the main passage 7. In other words, the leaking steam flowing out from the clearance passage 13 into the main passage 7 forms the flow that has almost no circumferential velocity component. Therefore, as shown in FIG. 5, the flown angle is nearly equal to zero even in the area close to the blade tip. In the present embodiment, the existence of the projecting portion 16 can reduce the radial velocity of the leaking steam flowing out from the clearance passage 13 into the main passage 7. Therefore, as shown in FIG. 5, the blade-height-directional area subjected to the influence of the leaking steam is relatively small. As shown in FIG. 6, the mixing loss can be reduced to allow for an improvement in stage efficiency as a result.

The advantage of the present embodiment is greater in the case of a plurality of the stages than in the case where the stage which is a combination of a rotor blade row and a stator blade row is single. As described above, the conventional art is such that the flow angle of the area close to the blade tip is different from that in the other area, i.e., the flow is twisted in the blade-height direction. The inlet blade angle of the stator angle does not largely change in the blade-height direction. Therefore, if the above-mentioned flow moves toward the downstream side stator blades, the development of an end face boundary layer and the growth of a secondary flow are promoted to cause an interference loss. In the present embodiment, in contrast, the flow angle in the area close to the blade tip is almost the same as in the other area as described above, so that the flow is uniform in the blade-height direction. Even if the above-mentioned flow moves toward the stator blades, the incidence of the stator blade is not largely altered, so that the occurrence of the interference loss can be suppressed. In other words, an increase in the secondary flow loss of the downstream side stator blade can be suppressed to allow for improved stage efficiency on the downstream side.

As shown in FIG. 4, the first embodiment describes as an example the case where the circumferential intervals (angle basis) of the shielding plates 18 are almost the same as the circumferential intervals (angle basis) of the rotor blades 5. In other words, the number of the shielding plates 18 is the same as that of the rotor blades 5. However, the present invention is not limited to this. Alteration or modification can be done in a range not departing from the gist and technical concept of the present invention. Specifically, depending on the circumferential velocity of the leaking steam flowing into the clearance passage 13 from the downstream side of the stator blade 2 in the main passage 7, even if the number of the shielding plates 18 is made less than that of the rotor blades 5, the same advantage as that in the first embodiment described above can be obtained. In such a case, the number of the shielding plates 18 can be made less than that of the rotor blades 5.

The first embodiment describes as an example the case where the circumferential velocity of the main flow steam on the downstream side of the rotor blade 5 (i.e., on the upstream side of the stator blade 2) in the main passage is nearly equal to zero; therefore, the shielding plates 18 are arranged perpendicularly to the tangential direction of the rotation of the rotor 4. However, the present invention is not limited to this. Alteration or modification can be done in a range not departing from the gist and technical concept of the present invention. Specifically, depending on the circumferential velocity of the steam on the downstream side of the rotor blade 5 in the main passage 7, the shielding plate 18 may slightly be inclined in the circumferential direction of the rotor. Such a case also can produce the same effect as that of the first embodiment.

Figure 7:
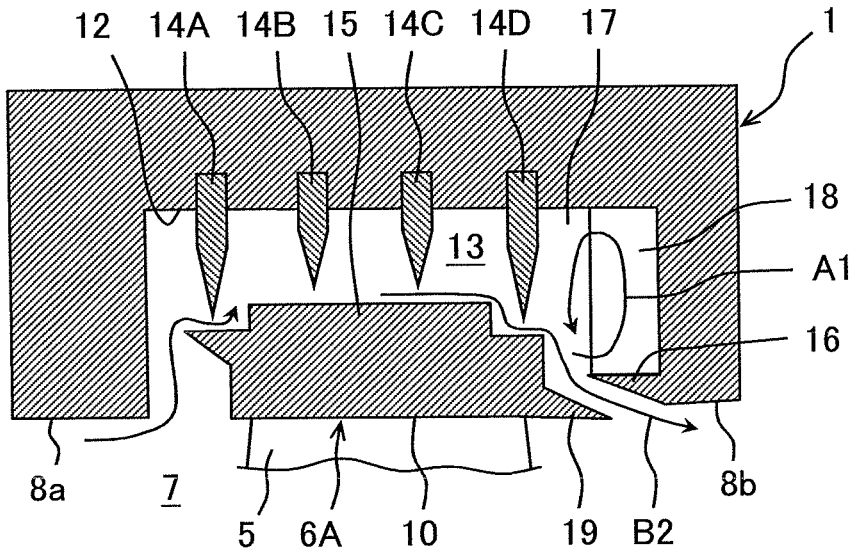
FIG. 7 is a partially-enlarged cross-sectional view illustrating the detailed structure of a clearance passage according to one modification of the present invention.

The above first embodiment describes as an example the case where no projecting portion is provided on the downstream-side end face of the shroud 6 as illustrated in FIG. 2. However, the present invention is not limited to this. A projecting portion may be provided on the downstream-side end face of the shroud 6. Specifically, as shown in e.g. an modification in FIG. 7, an inside projecting portion 19 may be provided on the downstream-side end face of the shroud 6A in such a manner as to be located on the rotor radial inside (the downside in the figure) of the projecting portion 16. The outer circumferential surface of the inside projecting portion 19 faces the inner circumferential surface of the projecting portion 16. In addition, the outer circumferential surface of the projecting portion 19 inclines from the outside (the upside in the figure) to the inside (the downside in the figure) in the rotor-axial direction in such a manner as to extend from the upstream side (the left side in the figure) toward the downstream side (the right side in the figure) in the rotor-axial direction. In other words, a guide passage for the leaking steam is defined between the inner circumferential surface of the projecting portion 16 and the outer circumferential surface of the inside projecting portion 19. As shown by arrow B2 in the figure, the flow direction of the leaking steam flowing out from the clearance passage 13 into the main passage 7 can be more directed to the rotor axial direction. Thus, the effect of reducing the mixing loss and the interference loss can be further enhanced to improve the stage efficiency as well as the effect of preventing the backflow of steam.

Figure 8:
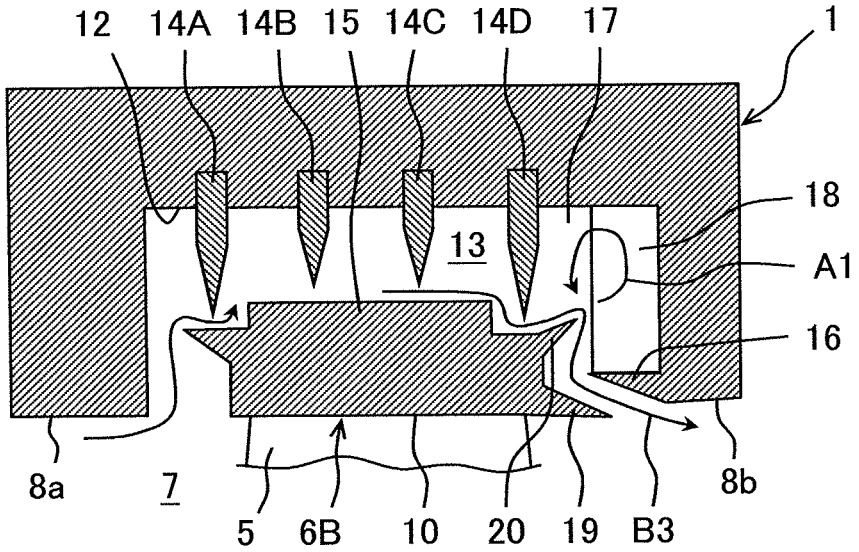
FIG. 8 is a partially-enlarged cross-sectional view illustrating the detailed structure of a clearance passage according to another modification of the present invention.

Alternatively, as in another modification shown in FIG. 8 an outside projecting portion 20 located on the rotor radial outside (the upside in the figure) of the projecting portion 16 may be provided on the downstream-side end face of a shroud 6B. The outer circumferential surface of the outside projecting portion 20 inclines from the inside (the downside in the figure) to the outside (the upside in the figure) in the rotor-radial direction in such a manner as to extend from the upstream side (the left side in the figure) toward the downstream side (the right side in the figure) in the rotor-axial direction. As shown by arrow B3 in the figure, the leaking steam that has passed through the clearance between the tip of the final-stage seal fin 14D and the outer circumferential surface of the shroud 6B changes its direction toward the rotor-radial outside and easily enters the circulation flow generating chamber 17. Therefore, the circulation flow A1 can be strengthened to enhance the effect of removing the circumferential velocity component due to the interference of the circulation flow A1. Thus, the effect of reducing the mixing loss and the interference loss can be further enhanced to allow for an increase in stage efficiency.

The above-mentioned first embodiment and modifications describe the labyrinth seal having the four-stage seal fins (14A to 14D) and one stepped portion 15 by way of example. However, the present invention is not limited to this. The labyrinth seal can be modified in a range not departing from the gist and technical concept of the present invention. Specifically, the number of the stages of the seal fins is not limited to four but may be two, three, five or more. The labyrinth seal may have no stepped portion or may have two or more stepped portion. These cases can produce the same effect as above too.

The first embodiment describes as an example the configuration where the final-stage seal fin 14D is provided on the inner circumferential surface of the groove portion 12 of the diaphragm outer ring 1. The tip of the projecting portion 16 is located at the rotor-radial inside of the outer circumferential surface of the shroud 6 to which the final-stage seal fin 14D is opposed. However, the present invention is not limited to this. Such a configuration can be modified or altered in various ways in a range not departing from the gist and technical concept of the present invention. Specifically, the final stage seal fin may be provided on the outer circumferential surface of the shroud 6. The tip of the projecting portion 16 may be located, for example, at a position on the rotor-radial inside of the tip (an outer circumferential edge) or a root (an inner circumferential edge) of the final stage seal fin. Such a case can produce the same effect as above too.

A second embodiment of the present invention is described with reference to FIG. 9. In the present embodiment the same portions as those in the above first embodiment are denoted by like reference numerals and their explanations are arbitrarily omitted.

Figure 9:
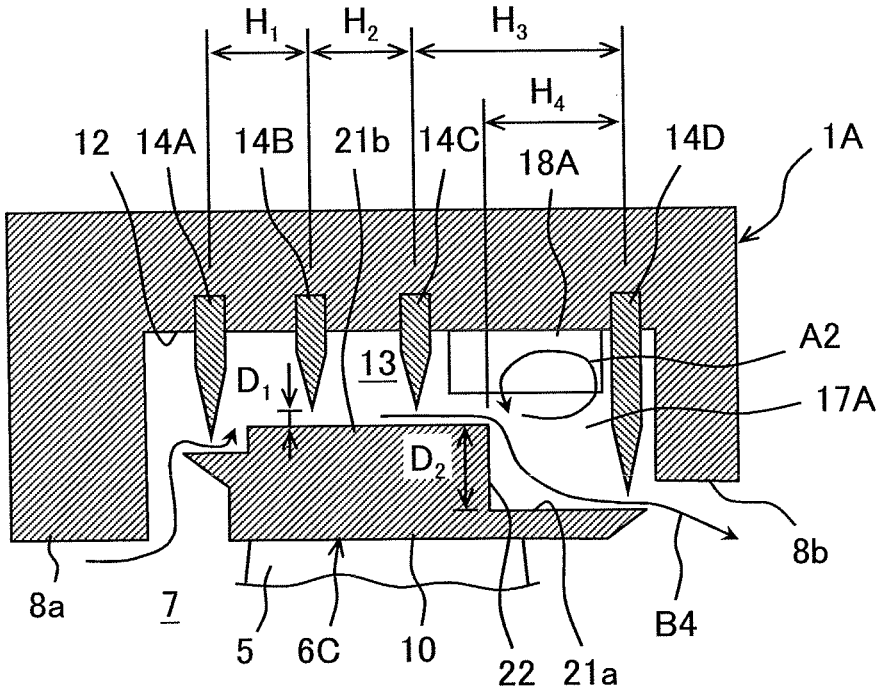
FIG. 9 is a partially-enlarged cross-sectional view illustrating the detailed structure of a clearance passage according to a second embodiment of the present invention.

FIG. 9 illustrates a detailed structure of a clearance passage according to the second embodiment.

In the present embodiment, a cutout is formed in the downstream side end portion of a shroud 6C. Specifically, the shroud 6C has an outer circumferential surface 21*a* to which a final-stage seal fin 14D is opposed, an outer circumferential surface 21*b* which is located on the rotor-radial outside (the upside in the figure) of the outer circumferential surface 21*a* and to which the seal fin 14C anterior to the final stage seal fin is opposed, and a stepped lateral surface 22 formed between the outer circumferential surface 21*a* and the outer circumferential surface 21*b*.

A clearance dimension $D_1$ between the tip of each seal fin and the outer circumference of the shroud 6*c* facing thereto is set so that similarly to the first embodiment the flow rate of leaking steam may be minimized while preventing the stationary body side and the rotating body side from coming into contact with each other. A rotor-radial dimension $D_2$ (a step dimension) of the stepped lateral surface 22 is set e.g. five or more times the above-mentioned clearance dimension $D_1$ mentioned above (about six to eight times in the present embodiment). The seal fin 14D is longer than the seal fin 14C by the above-mentioned step dimension $D_2$. In other words, the tip of the seal fin 14D is located on the rotor-radial inside (the downside in the figure) of the outer circumference 21*b*.

A rotor-axial dimension $H_3$ between the seal fin 14C and the seal fin 14D is set two or more times (about two to three times in the present embodiment) a rotor-axial dimension $H_1$ between the seal fin 14A and the seal fin 14B or a rotor-axial dimension $H_2$ between the seal fin 14B and the seal fin 14C. A rotor-axial dimension $H_4$ between the seal fin 14D and the step lateral surface 22 is greater than the above-mentioned dimension $H_1$ or $H_2$.

With the above-mentioned structure, a circulation flow generating chamber 17A is defined by the final stage seal fin 14D, the seal fin 14C anterior thereto, and a portion of the inner circumferential surface of the groove portion 12 located between the seal fins 14C and 14D. The leaking steam that has passed through the clearance between the tip of the seal fin 14C and the outer circumferential surface 21*b* of the shroud 6C flows into the circulation flow generating chamber 17A and hits the seal fin 14D and other surfaces to generate a circulation flow A2.

A plurality of shielding plates 18A arranged circumferentially at given intervals are secured to the inner circumferential surface of the groove portion 12 in such a manner as to be located between the seal fins 14C and 14D (to be located in the circulation flow generating chamber 17A). The shielding plate 18A extends in the rotor-axial direction and in the rotor-radial direction. In the present embodiment, the shielding plate 18A is a flat plate disposed perpendicularly to the tangential direction of the rotation of the rotor 4. The leaking steam (the circulating flow A2) that has flowed into the circulating flow generating chamber 17*a* hits the shielding plates 18A to suppress the circumferential velocity component of the circulating flow A2. The interference of the circulation flow A2 thus generated can effectively remove the circumferential velocity component from the flow B4 of the leaking steam flowing out from the clearance passage 13 toward the downstream side of the rotor blade 5 in the main passage 7. In other words, the circumferential velocity component can effectively be removed regardless of the magnitude of the circumferential velocity of the leaking steam compared with the case where the leaking steam is allowed to pass between the guide plates as described in JP-2011-106474-A.

In the present embodiment, the inner circumferential surface 8*b* of the diaphragm outer ring 1A is located on the rotor-radial outside of the tip of the seal fin 14D. Thus, the leaking steam flowing out from the clearance passage 13 toward the downstream side of the rotor blade 5 in the main passage 7 can be directed to the rotor-axial direction. At the time of starting a steam turbine, a relative positional relationship between the stationary body side and the rotating body side may largely be deviated to the axial direction due to a thermal expansion difference between the stationary body side and the rotating body side. Even in such a case, it is designed that the downstream side end portion of the shroud 6C and the diaphragm outer ring 1 do not hit with each other.

The embodiment described above can enhance the effect of reducing a mixing loss and the like similarly to the first embodiment.

The above embodiments describe the steam turbine, which is one of axial flow turbines, as an object to which the present invention is applied by way of example. However, the present invention is not limited to this. The present invention may be applied to a gas turbine and other turbines. This case can produce the same effect as above too.

What is claimed is:

1. An axial flow turbine comprising:

a plurality of stator blades provided on the inner circumferential side of a stationary body and circumferentially arranged;

a plurality of rotor blades provided on the outer circumferential side of a rotating body and circumferentially arranged;

a main passage in which the stator blades and the rotor blades on the downstream side of the stator blades are arranged, the main passage through which working fluid flows;

a shroud provided on the outer circumferential side of the rotor blades;

an annular groove portion formed in the stationary body and housing the shroud therein;

a clearance passage formed between the groove portion and the shroud, wherein a portion of the working fluid flows from the downstream side of the stator blades in the main passage into the clearance passage and flows out toward the downstream side of the rotor blades in the main passage;

a plurality of stages of seal fins provided in the clearance passage;

a circulation flow generating chamber defined on the downstream side of the clearance passage; and a plurality of shielding plates secured to the stationary body in such a manner as to be located in the circulation flow generating chamber, the shielding plates extending in axial and radial directions of the rotating body, wherein provided is an annular first projecting portion projecting from a downstream-side lateral surface of the groove portion toward a downstream-side end face of the shroud, and the circulation flow generating chamber is defined by a portion of an inner circumferential surface of the groove portion located on the downstream side of a final stage seal fin of the stages of seal fins, the downstream-side lateral surface of the groove portion, and an outer circumferential surface of the first projecting portion.

2. The axial flow turbine according to claim 1, wherein an annular outside projecting portion is provided on the downstream-side end face of the shroud in such a manner so as to be located on a radial outside of the rotating body with respect to the first projecting portion, and an outer circumferential surface of the outside projecting portion is inclined from the inside toward the outside in the radial direction of the rotating body in such a manner as to extend from the upstream side toward the downstream side in the axial direction of the rotating body.

3. An axial flow turbine comprising:

a plurality of stator blades provided on the inner circumferential side of a stationary body and circumferentially arranged;

a plurality of rotor blades provided on the outer circumferential side of a rotating body and circumferentially arranged;

a main passage in which the stator blades and the rotor blades on the downstream side of the stator blades are arranged, the main passage through which working fluid flows;

a shroud provided on the outer circumferential side of the rotor blades;

an annular groove portion formed in the stationary body and housing the shroud therein;

a clearance passage formed between the groove portion and the shroud, wherein a portion of the working fluid flows from the downstream side of the stator blades in the main passage into the clearance passage and flows out toward the downstream side of the rotor blades in the main passage;

a plurality of stages of seal fins provided in the clearance passage;

a circulation flow generating chamber defined on the downstream side of the clearance passage; and a plurality of shielding plates secured to the stationary body in such a manner as to be located in the circulation flow generating chamber, the shielding plates extending in axial and radial directions of the rotating body, wherein the stages of seal fins are provided on the inner circumferential surface of the groove portion;

the shroud includes a first outer circumferential surface to which a final stage seal fin among the plurality of stages of seal fins is opposed, a second circumferential surface which is located on a rotor-radial outside of the first outer circumferential surface and to which a seal fin of a stage anterior to the final stage is opposed, and a stepped lateral surface formed between the first outer circumferential surface and the second outer circumferential surface, a tip of the final stage seal fin is located on the rotor-radial inside of the second outer circumferential surface, a rotor-axial dimension between the final stage seal fin and the seal fin of the stage anterior to the final stage and a rotor-axial dimension between the final stage seal fin and the stepped lateral surface are greater than a rotor-axial dimension between other seal fins, and the circulation flow generating chamber is defined by the final stage seal fin, the seal fin of the stage anterior to the final stage, and a portion of the inner circumferential surface of the groove portion located between the final stage seal fin and the seal fin of the stage anterior to the final stage.

* * * * *